US007245860B2

(12) United States Patent
Huang et al.

(10) Patent No.: US 7,245,860 B2
(45) Date of Patent: Jul. 17, 2007

(54) TONER CARTRIDGE

(75) Inventors: Ya-Li Huang, Taichung County (TW); Ren-Hao Liu, Taichung (TW); Chin-His Chuang, Changhua County (TW); Kuan-Tung Li, Yunlin County (TW)

(73) Assignee: General Plastic Industrial Co., Ltd., Taichung County (TW)

( * ) Notice: Subject to any disclaimer, the term of this patent is extended or adjusted under 35 U.S.C. 154(b) by 305 days.

(21) Appl. No.: 11/088,827

(22) Filed: Mar. 25, 2005

(65) Prior Publication Data

US 2006/0216068 A1 Sep. 28, 2006

(51) Int. Cl.
*G03G 15/08* (2006.01)

(52) U.S. Cl. ..... 399/262; 399/106

(58) Field of Classification Search ..... 399/102, 399/103, 106, 111, 119, 252, 258, 262; 222/DIG. 1
See application file for complete search history.

(56) References Cited

U.S. PATENT DOCUMENTS 6,324,371 B1 * 11/2001 Okiyama et al. ..... 399/262
6,496,671 B2 * 12/2002 Nakajima ..... 399/120
6,654,569 B2 * 11/2003 Nozawa ..... 399/27

* cited by examiner

*Primary Examiner*—Hoan Tran
(74) *Attorney, Agent, or Firm*—Browdy and Neimark, PLLC

(57) ABSTRACT

A toner cartridge includes a housing, which has a receiving portion, a tubular portion, a first accommodating chamber defined in the tubular portion, a second accommodating chamber defined in the receiving portion in communication with the first accommodating chamber, and an outlet formed in the tubular portion in communication with the first accommodating chamber and the outside of the housing, an inner tube, which is rotatably mounted in the first accommodating chamber of the housing and which has plate portions and a slot communicatable with the outlet, and a seal, which is fixedly provided at an outer side of the inner tube and attachable to an inner surface of the tubular portion to prevent leakage of toner and which has a slot in communication with the slot of the inner tube.

15 Claims, 12 Drawing Sheets

TONER CARTRIDGE

BACKGROUND OF THE INVENTION

1. Field of the Invention

The present invention relates to an electronic image forming apparatus and more particularly, to a toner cartridge for use in an electronic image forming apparatus, which effectively prevents leakage of toner.

2. Description of the Related Art

FIGS. 1 and 2 show a toner cartridge according to the prior art. According to this design, the toner cartridge 1 is comprised of a housing 2 and an inner tube 3. The housing 2 comprises a tubular portion 4 and a receiving portion 5 for holding toner. The tubular portion 4 is a cylindrical member. The inner tube 3 is rotatably mounted in the tubular portion 4. The receiving portion 5 has an irregular shape fitting the holder of toner cartridge. The inner tube 3 has a slot 6 at the bottom side for communicating the outlet 7 of the housing 2, and an open-space portion 8 at the top side for communication between the inside space of the inner tube 3 and the inside space of the housing 2.

Toner is allowed to pass from the housing 2 to the inner tube 3 through the open-space portion 8. When rotated the inner tube 3 to the open position as shown in FIG. 1, the slot 6 is in communication with the outlet 7, allowing toner to pass from the inner tube 3 through the slot 6 and the outlet 7 to the outside of the housing 2. On the contrary, when rotated the inner tube 3 to the close position, as shown in FIG. 2, the slot 6 is blocked from the outlet 7, and toner is stopped from passing to the outside of the toner cartridge 1.

In order to prevent leakage of toner through gaps between the inner tube 3 and the tubular portion 4 of the housing 2, sealing members 9 (for example, sponge members) may be fixedly fastened to the outside wall of the inner tube 3. However, because the inner tube 3 and the tubular portion 4 of the housing 2 are cylindrical members, the clearance between the outside wall of the inner tube 3 and the inside wall of the tubular portion 4 of the housing 2 maintains unchanged during rotary motion of the inner tube 3 relative to the housing 2, the sealing members 9 wear quickly with use, causing leakage of the toner, and toner may be accumulated in gaps between the sealing members 9 and the housing 2.

SUMMARY OF THE INVENTION

It is one objective of the present invention to provide a toner cartridge, which effectively prevents leakage of toner.

It is another objective of the present invention to provide a toner cartridge, which prevents accumulation of toner in between the housing and the seal.

To achieve these objectives of the present invention, the toner cartridge comprises a housing, an inner tube, and a seal. The housing comprises a receiving portion, a tubular portion, a first accommodating chamber defined in the tubular portion, a second accommodating chamber defined in the receiving portion in communication with the first accommodating chamber, and an outlet formed in the tubular portion in communication with the first accommodating chamber and the outside of the housing. The inner tube is rotatably mounted in the first accommodating chamber of the housing, having plate portions and a slot communicatable with the outlet. The seal is fixedly provided at an outer side of the inner tube and attachable to an inner surface of the tubular portion to prevent leakage of toner, having a slot in communication with the slot of the inner tube.

DETAILED DESCRIPTION OF THE INVENTION

Figure 1:
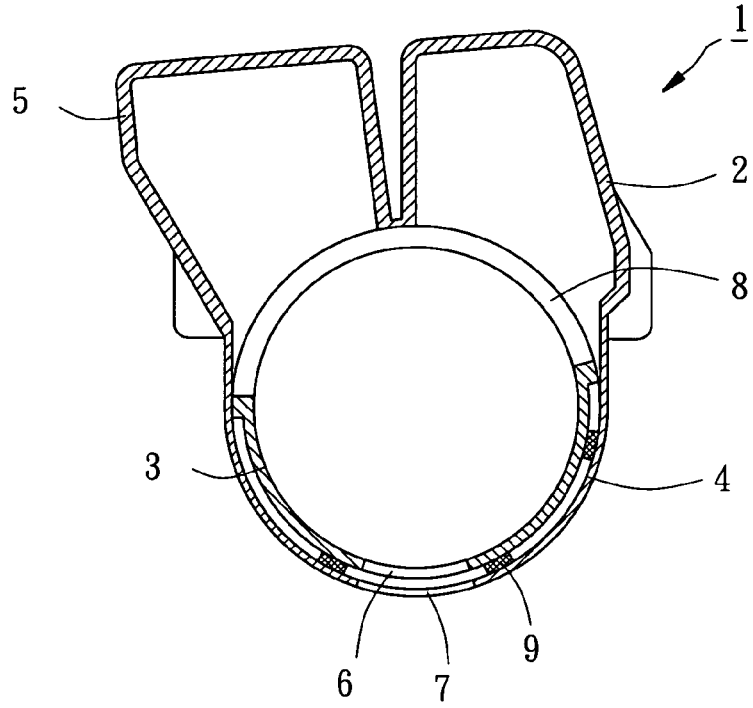
FIG. 1 PRIOR ART
FIG. 1 is a sectional view of a toner cartridge according to the prior art.
Figure 2:
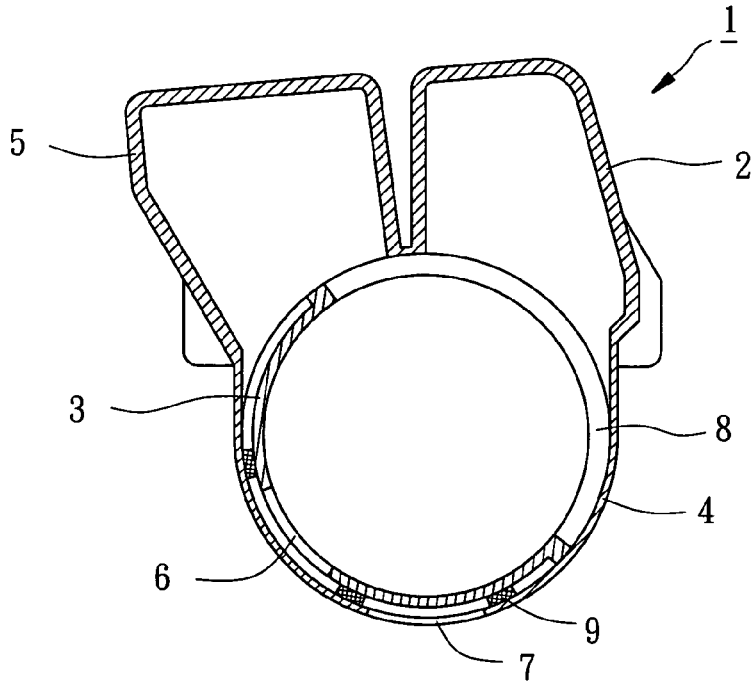
FIG. 2 PRIOR ART
FIG. 2 is a schematic drawing showing the prior art toner cartridge in action.
Figure 3:
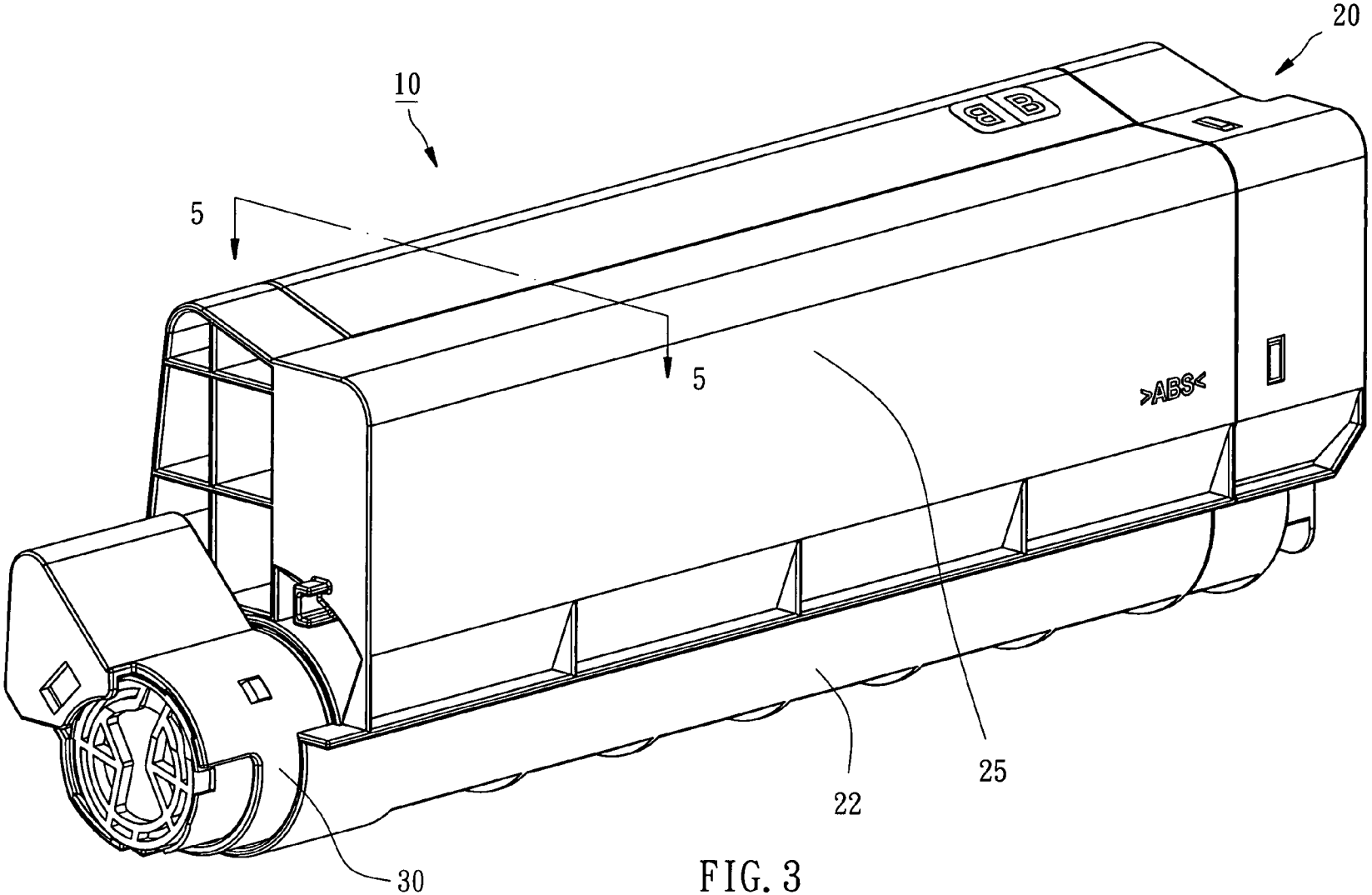
FIG. 3 is a perspective view of a toner cartridge according to a first preferred embodiment of the present invention.
Figure 4:
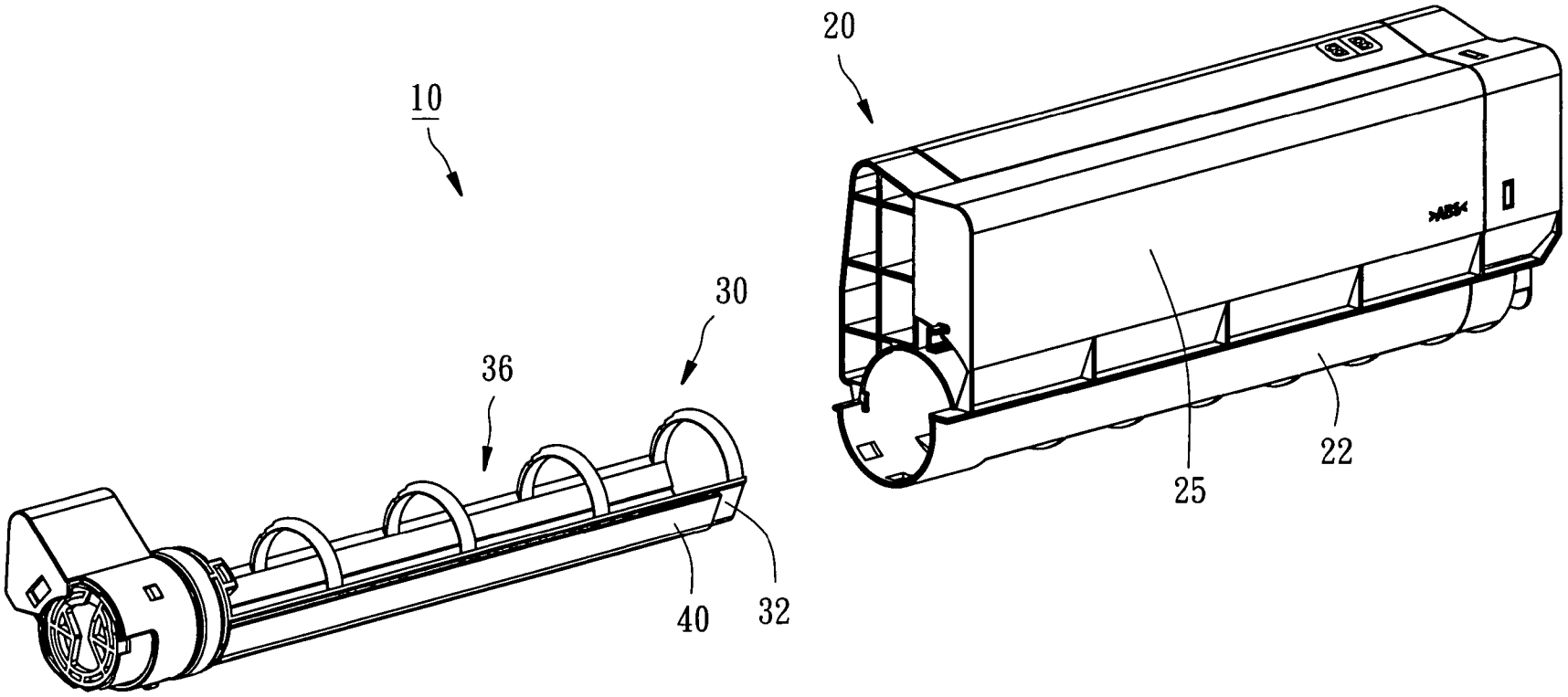
FIG. 4 is an exploded view of the toner cartridge according to the first preferred embodiment of the present invention.

Referring to FIGS. 3 through 4, a toner cartridge 10 in accordance with the first preferred embodiment of the present invention is shown comprised of a housing 20, an inner tube 30, and a seal 40.

The housing 20 comprises a tubular portion 22 and a receiving portion 25. The tubular portion 22 is a cylindrical member having two flat walls 23 abutted against each other at the bottom side in a non-parallel manner and defining therebetween a contained angle $\alpha$ about 135°. Further, the tubular portion 22 defines a first accommodating chamber 24. The receiving portion 25 defines a second accommodating chamber 26 in communication with the first accommodating chamber 24 for holding toner. The tubular portion 22 has an outlet 28, which is formed in one of the flat walls 23 and is in communication between the first accommodating chamber 24 and the outside.

The inner tube 30 is mounted in the first accommodating chamber 24 and rotatable between a close position and an open position, comprising four plate portions 32 abutted against one another in a non-parallel manner at the bottom side, a slot 34 in one plate portion 32, and an open-space portion 36 at the top side in communication between the inside space of the inner tube 30 and the second accommodating chamber 26. Further, each two adjacent plate portions 32 define a contained angle $\beta$ about 135°.

The seal 40 is fixedly provided at the outer side of the inner tube 30 and closely attachable to the inner surface of the tubular portion 22 of the housing 20. The seal 40 is made of sponge or other elastic material, having a slot 42 in communication with the slot 34 of the inner tube 30.

Figure 5:
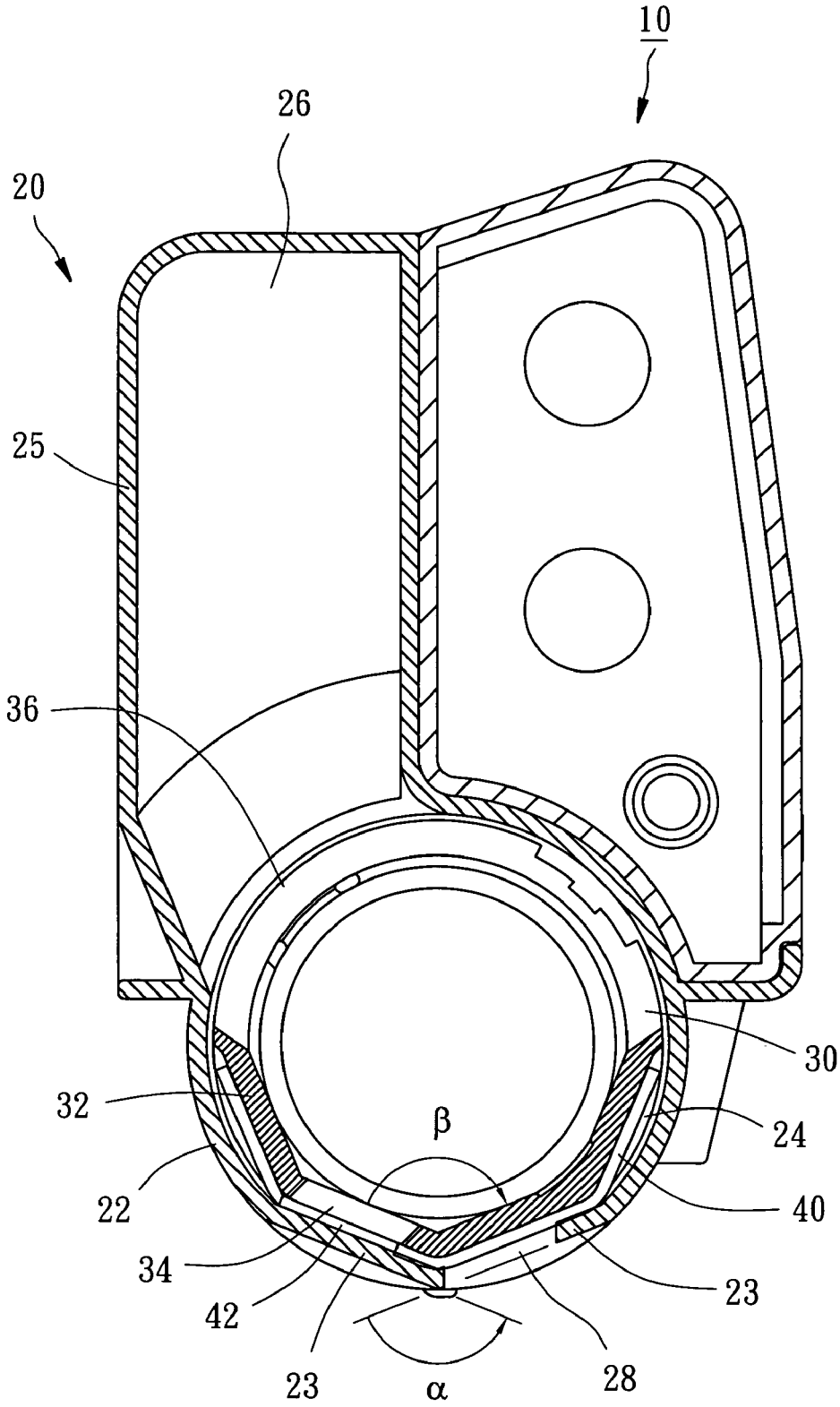
FIG. 5 is a sectional view taken along line 5-5 of FIG. 3.

Referring to FIG. 5, when rotated the inner tube 30 to the close position, the slot 34 of the inner tube 30 is not in communication with the outlet 28 of the housing 20, toner is blocked inside the housing 20, and the seal 40 stops toner from leaking out of the housing 20 to the outside of the toner cartridge 10.

Figure 6:
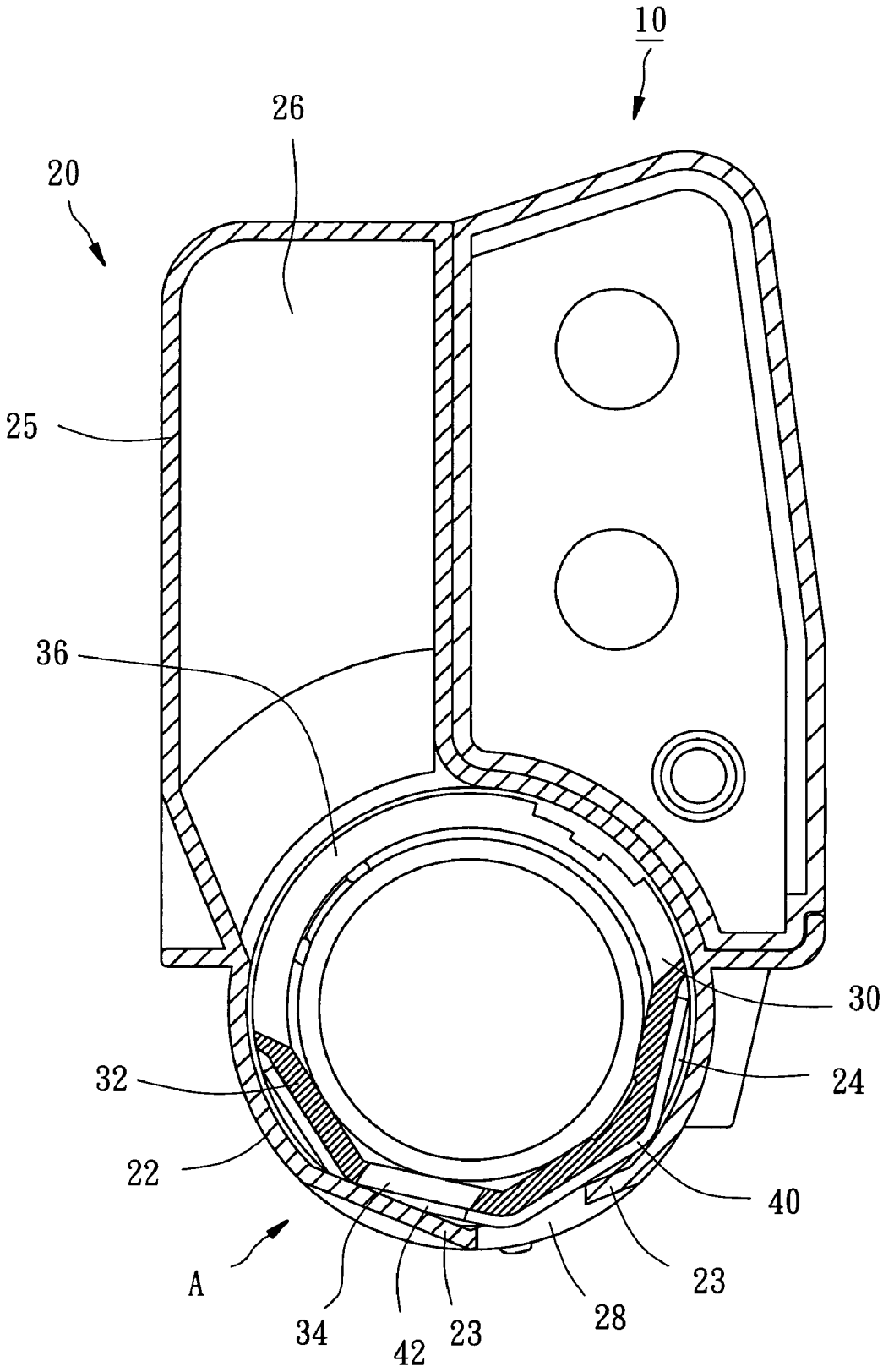
FIGS. 6-7 are schematic drawings showing the actions of the toner cartridge according to the first preferred embodiment of the present invention.

Referring to FIG. 6, when rotated the inner tube 30 to position A between the close position and the open position, the seal 40 is heavily compressed, preventing accumulation of toner in between the seal 40 and the housing 20.

Figure 7:
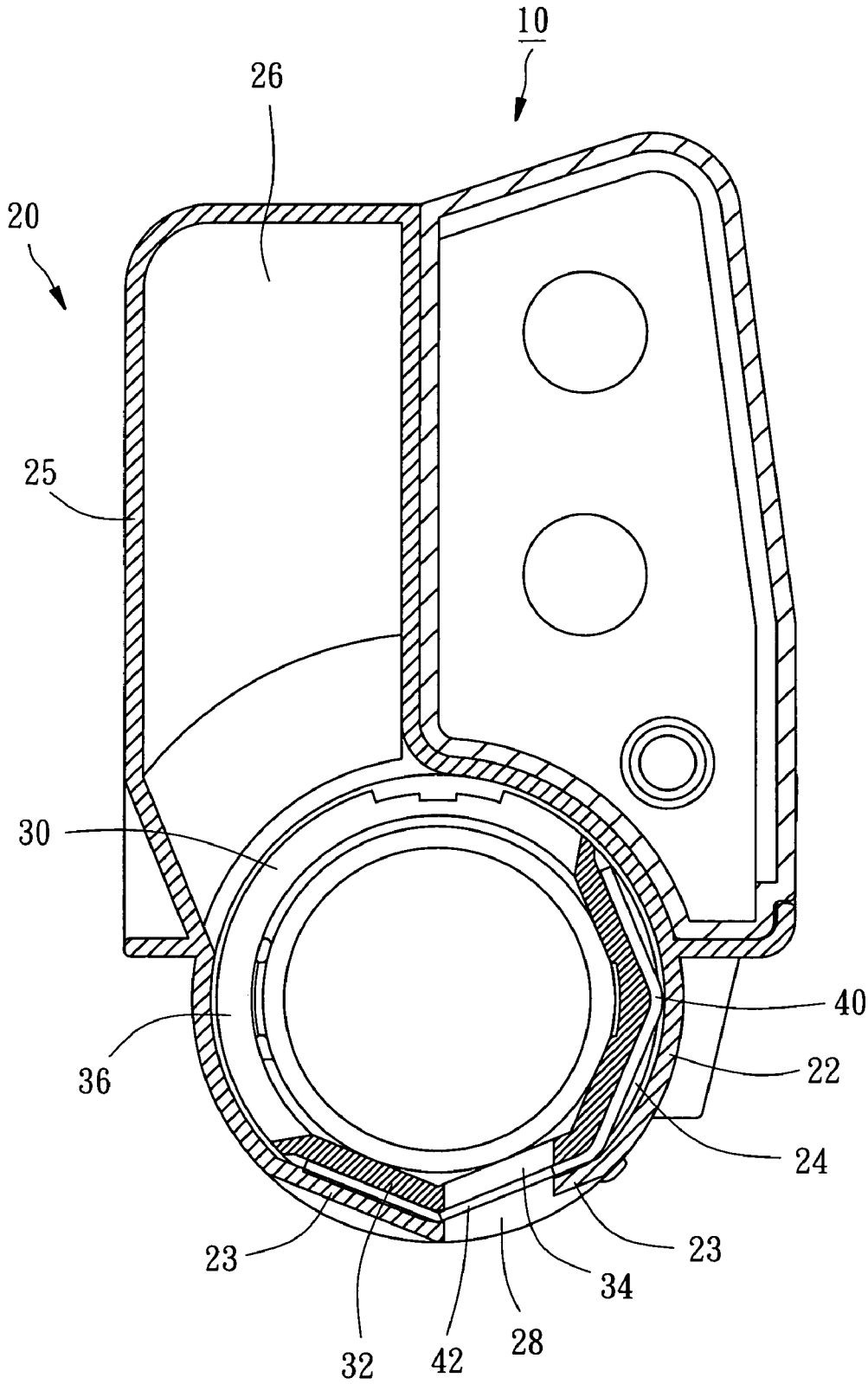

Referring to FIG. 7, when rotated the inner tube 30 to the open position, the slot 34 of the inner tube 30 is in communication with the outlet 28 of the housing 20, allowing toner to pass out of the housing 20. When rotating the inner tube 30 in the reversed direction from the open position toward the close position, the seal 40 will be compressed to move residual toner back to the inside of the housing 20.

By means of the aforesaid structural design, the seal 40 will be heavily compressed at the border area between each two plate portions 32 to prevent accumulation of toner in gaps between the seal 40 and the housing 20 and leakage of toner out of the outlet 28 during rotary motion of the inner tube 30 from the close position to the open position. The seal 40 will also be heavily compressed at the border area between each two plate portions 32 to prevent leakage of toner out of the outlet 28 during rotary motion of the inner tube 30 from the open position to the close position.

In fabrication, the number of the plate portions 32 of the inner tube 30 and the number of the flat walls 23 of the housing 20 can be changed subject to actual requirements. Actually, one plate portion 32 and one flat wall 23 are sufficient to achieve the designed functions. Further, the inner tube, the tubular portion of the housing, and the seal may be made to have a different shape without affecting the functioning of the present invention.

Figure 8:
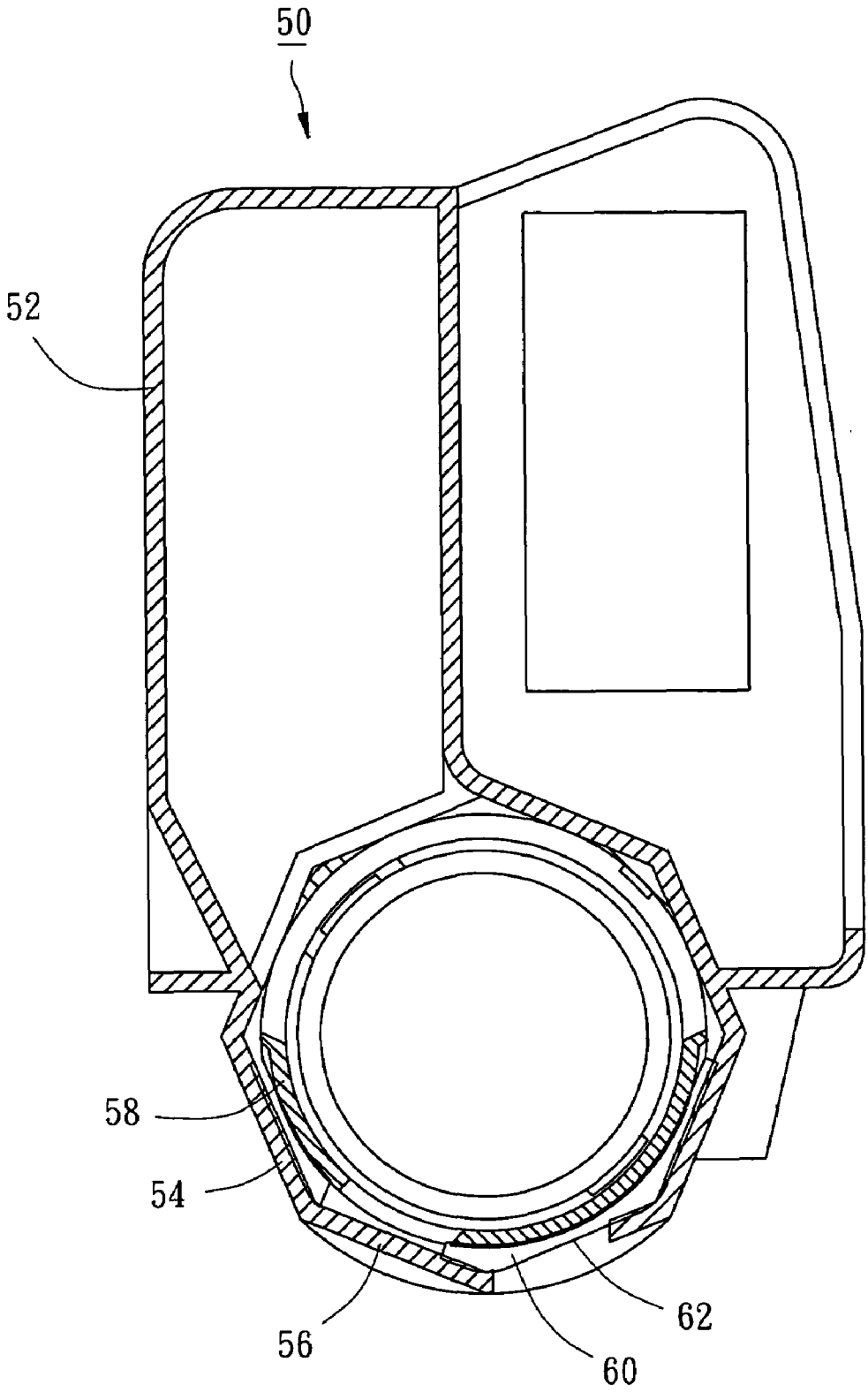
FIG. 8 is a sectional view of a toner cartridge according to a second preferred embodiment of the present invention.
Figure 9:
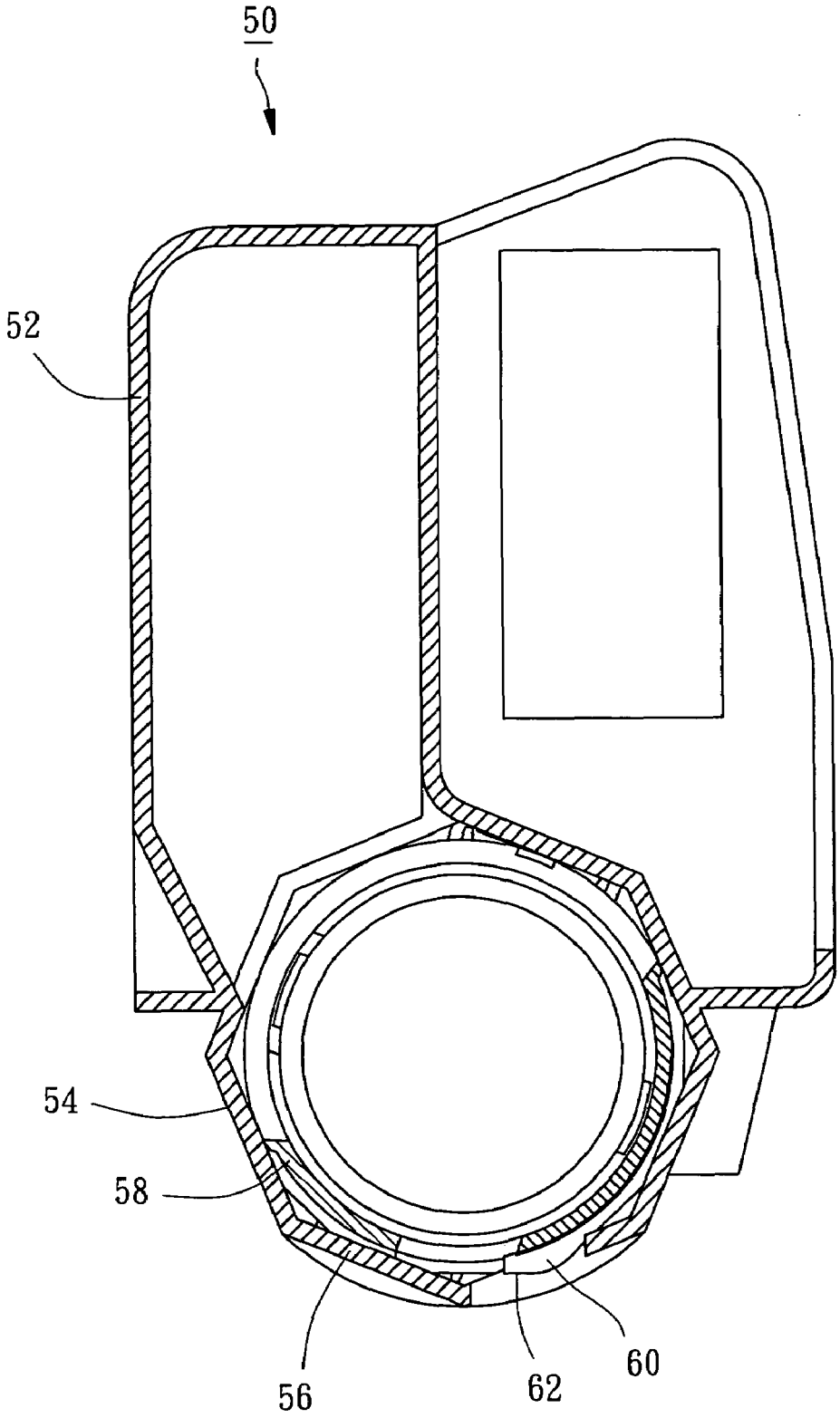
FIGS. 9-10 are schematic drawings showing the actions of the toner cartridge according to the second preferred embodiment of the present invention.
Figure 10:
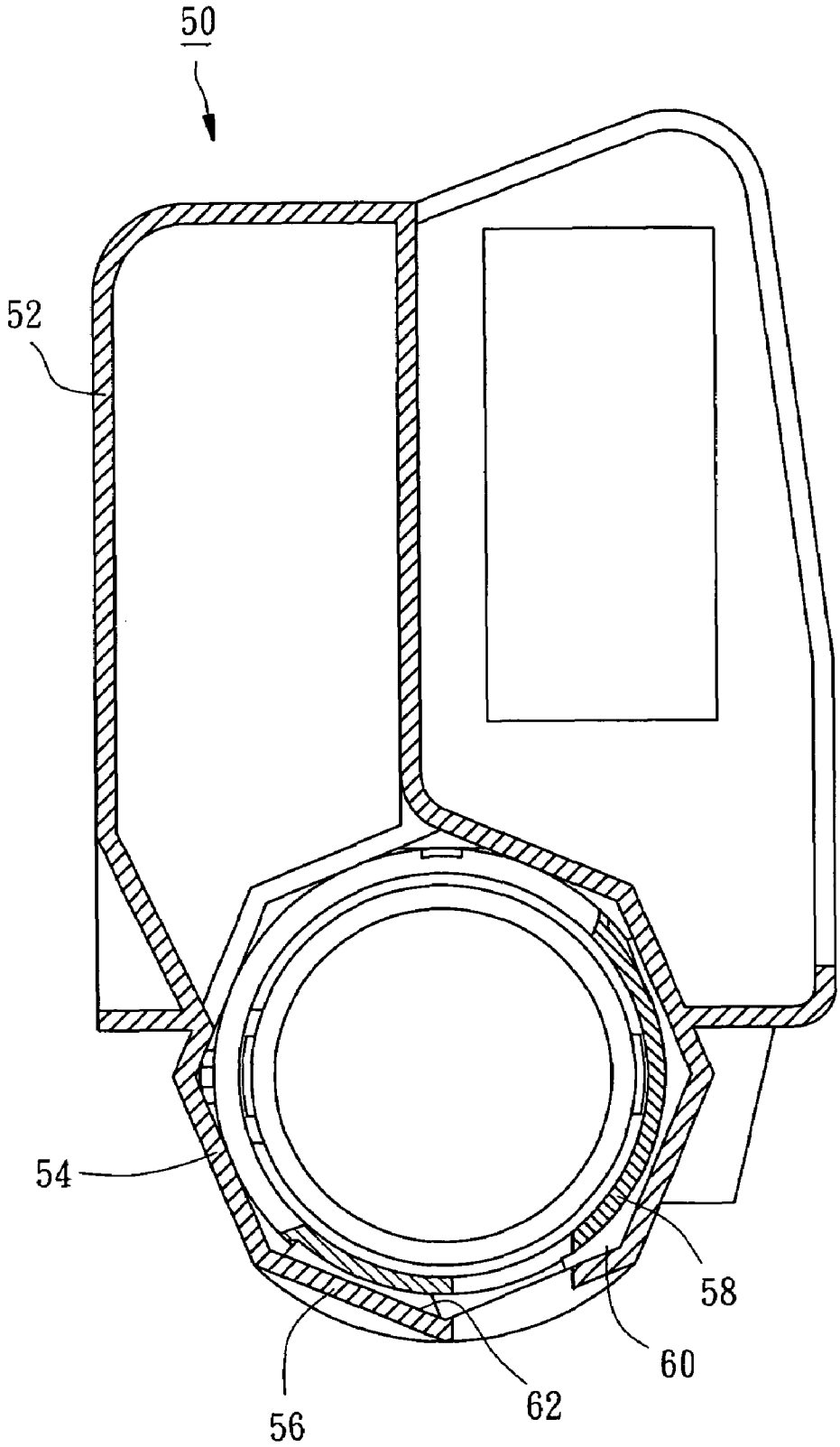

FIGS. 8-10 show a toner cartridge according to the second preferred embodiment of the present invention. According to this embodiment, the toner cartridge 50 is comprised of a housing 52, an inner tube 58, and a seal 60. The tubular portion 54 of the housing 52 has a polygonal cross section formed of a plurality of flat walls 56. The inner tube 58 is a cylindrical member on which the seal 60 having a plurality of outside stop walls 62 respectively closely attachable to the flat walls 56 of the tubular portion 54 of the housing 52 is attached. Actually, the outside stop walls 62 form a polygonal structure. When rotating the inner tube 58 relative to the housing 52, the seal 60 will be compressed, as shown in FIG. 9, preventing accumulation of toner in gaps between the seal 60 and the housing 52 or leakage of toner out of the housing 52.

Figure 11:
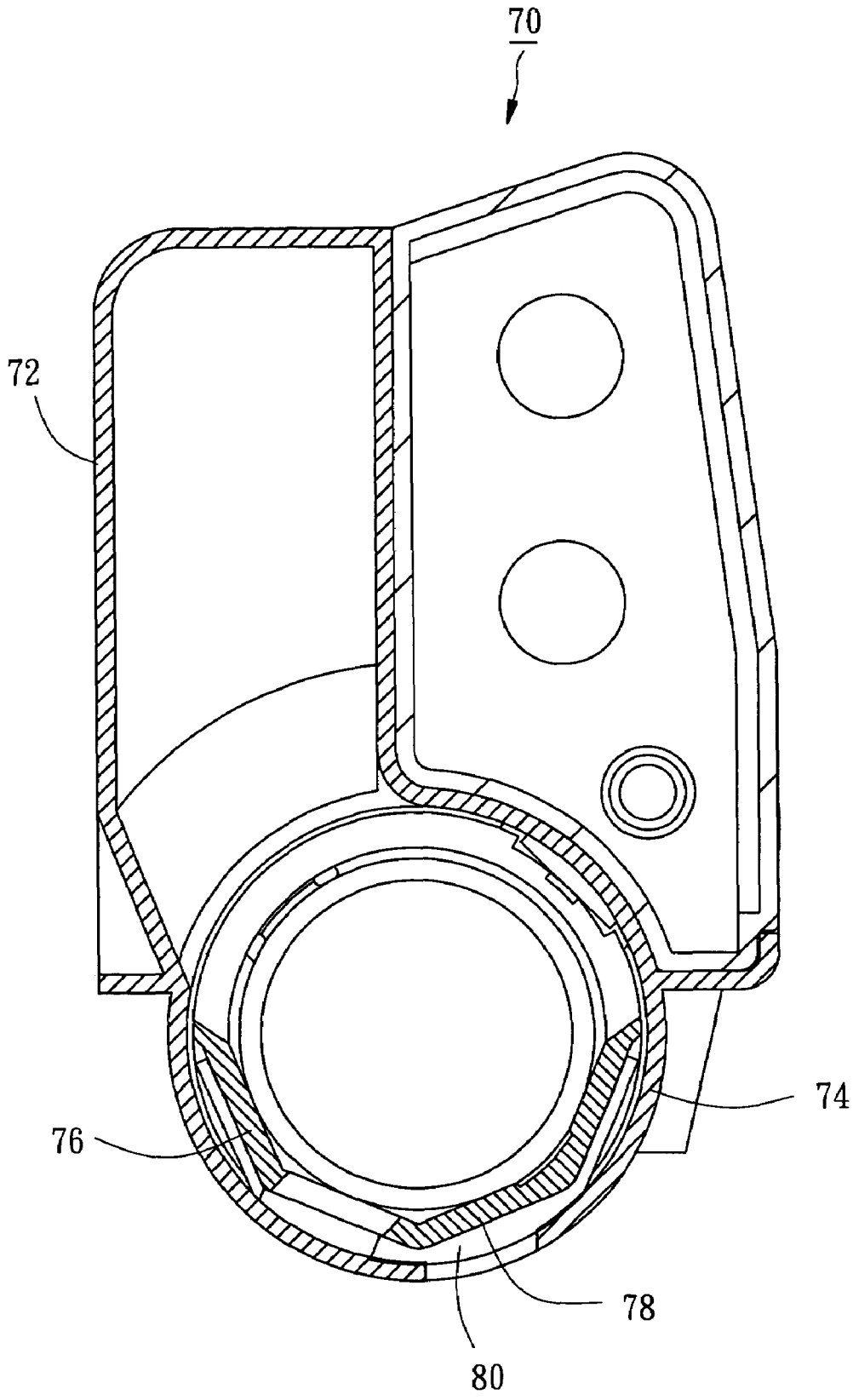
FIG. 11 is a sectional view of a toner cartridge according to a third preferred embodiment of the present invention.
Figure 12:
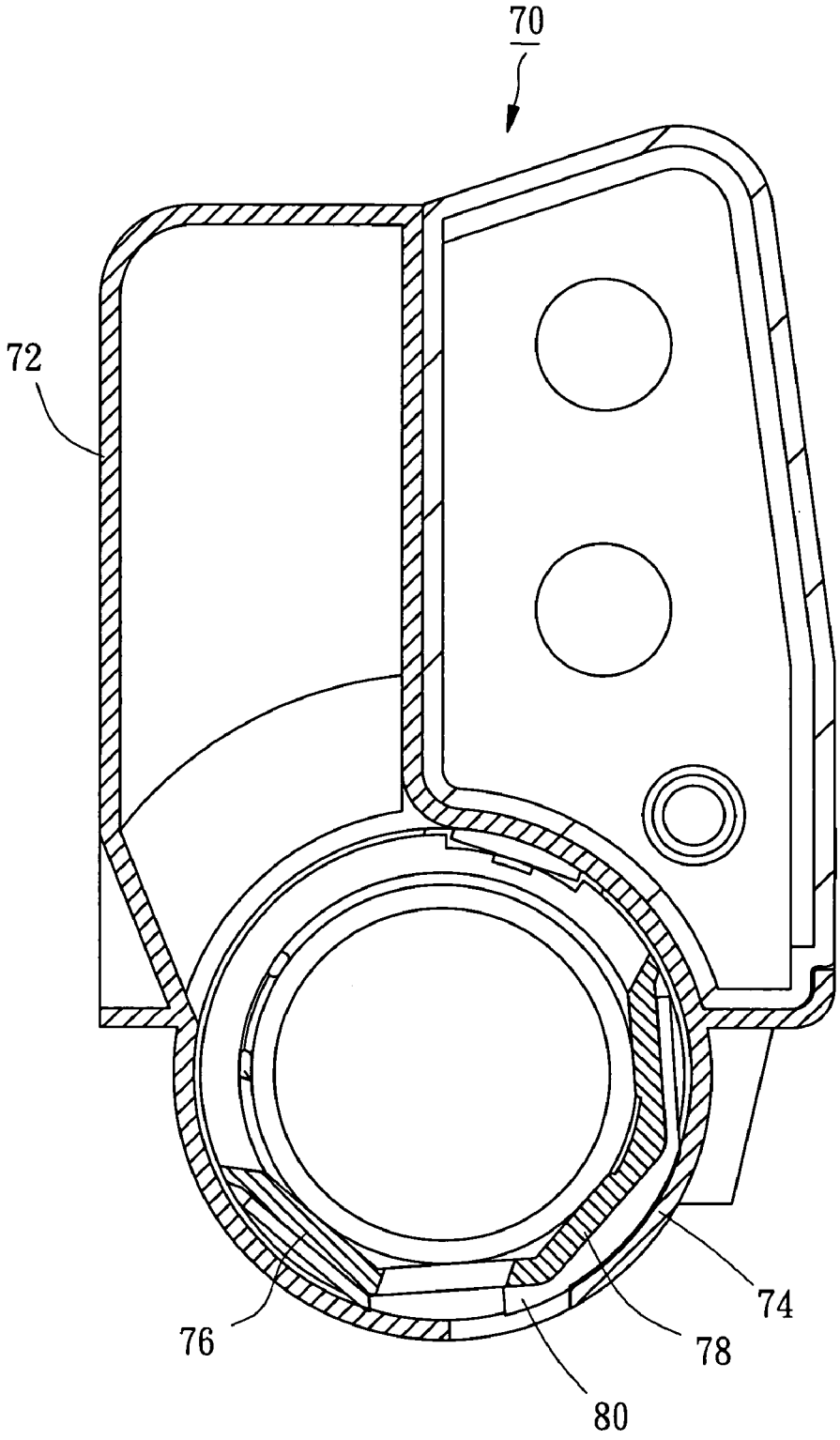
FIGS. 12-13 are schematic drawings showing the actions of the toner cartridge according to the third preferred embodiment of the present invention.
Figure 13:
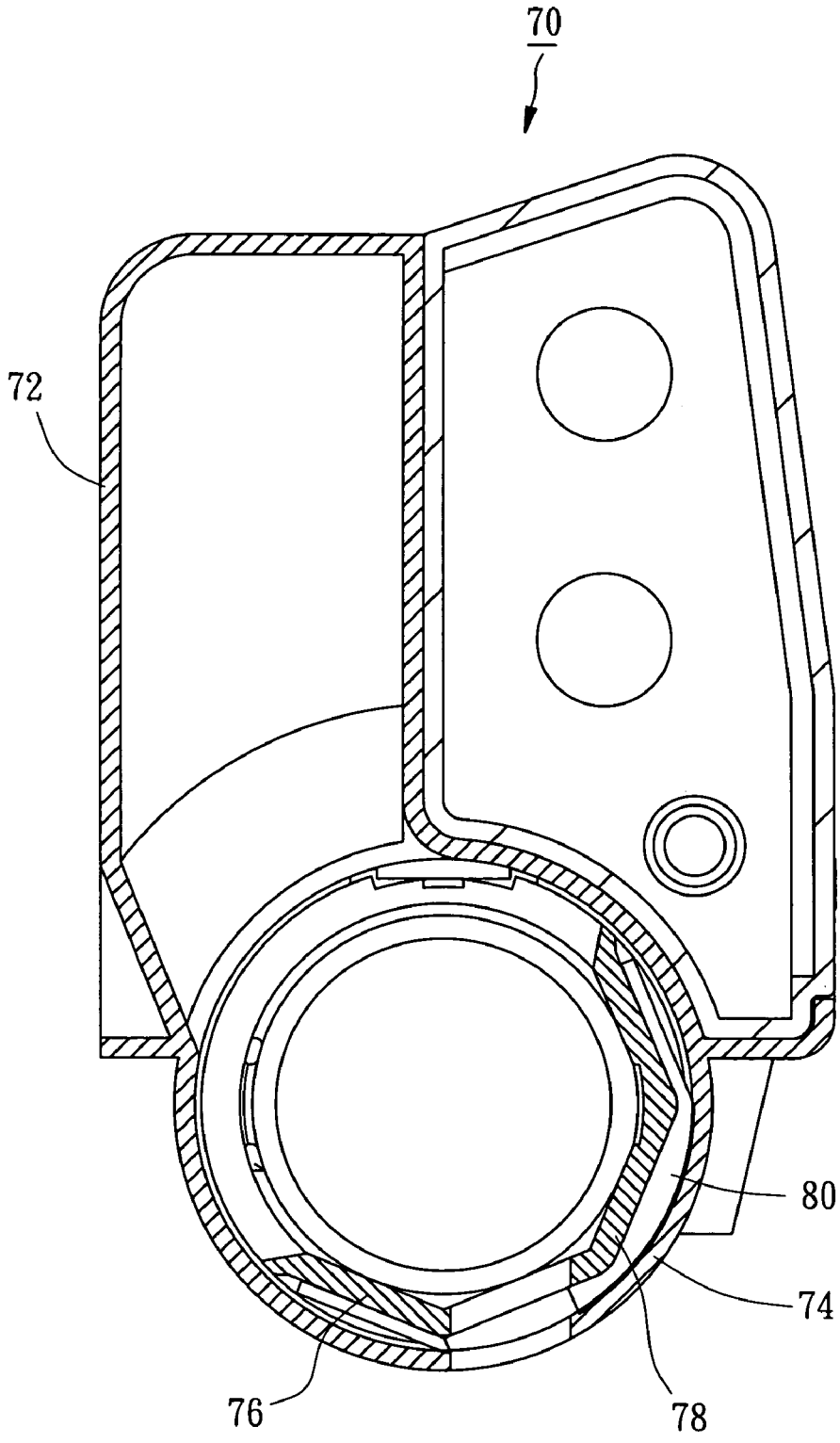

FIGS. 11-13 show a toner cartridge according to the third preferred embodiment of the present invention. According to this embodiment, the toner cartridge 70 is comprised of a housing 72, an inner tube 76, and a seal 80. The tubular portion 74 of the housing 72 has substantially a cylindrical shape. The inner tube 76 comprises a plurality of plate portions 78, forming a polygonal structure. The seal 80 is provided at the outer side of the inner tube 76 and closely attached to the tubular portion 74. This embodiment achieves the same function as the aforesaid first and second embodiments of the present invention.

Although particular embodiments of the invention have been described in detail for purposes of illustration, various modifications and enhancements may be made without departing from the spirit and scope of the invention. For example, the slot of the inner tube may be formed in between two adjacent plate portions or at another location; the outlet of the housing may be formed at a location adjacent to the flat walls or another suitable location. Accordingly, the invention is not to be limited except as by the appended claims

What is claimed is:

1. A toner cartridge comprising:

a housing having a receiving portion, a tubular portion, a first accommodating chamber defined in said tubular portion, a second accommodating chamber defined in said receiving portion in communication with said first accommodating chamber, and an outlet formed in said tubular portion in communication with said first accommodating chamber and the outside of said housing; and an inner tube rotatably mounted in said first accommodating chamber of said housing, said inner tube having at least one plate portion and a slot communicatable with the outlet.

2. The toner cartridge as claimed in claim 1, wherein the slot of said inner tube is substantially abutted against one said plate portion.

3. The toner cartridge as claimed in claim 1, wherein the slot of said inner tube is formed in one said plate portion.

4. The toner cartridge as claimed in claim 1, wherein said inner tube comprises a plurality of said plate portions abutted against one another in a non-parallel manner.

5. The toner cartridge as claimed in claim 1, wherein said tubular portion of said housing comprises at least one flat wall.

6. The toner cartridge as claimed in claim 5, wherein said outlet is formed in one said flat wall.

7. The toner cartridge as claimed in claim 5, wherein said outlet is substantially abutted against said at least one flat wall.

8. The toner cartridge as claimed in claim 1, wherein said tubular portion of said housing comprises a plurality of flat walls abutted against one another in a non-parallel manner.

9. The toner cartridge as claimed in claim 1, further comprising a seal fixedly provided at an outer side of said inner tube and attachable to an inner surface of said tubular portion of said housing, said seal having a slot in communication with the slot of said inner tube.

10. A toner cartridge comprising:

a housing having a receiving portion, a tubular portion, a first accommodating chamber defined in said tubular portion, a second accommodating chamber defined in said receiving portion in communication with said first accommodating chamber, and an outlet formed in said tubular portion in communication with said first accommodating chamber and the outside of said housing, said tubular portion comprising at least one flat wall; and an inner tube rotatably mounted in said first accommodating chamber of said housing, said inner tube having a slot communicatable with said outlet.

11. The toner cartridge as claimed in claim 10, wherein said outlet is formed in one said flat wall.

12. The toner cartridge as claimed in claim 10, wherein said outlet is substantially abutted against said flat wall.

13. The toner cartridge as claimed in claim 10, wherein said tubular portion of said housing comprises a plurality of said flat walls abutted against one another in a non-parallel manner.

14. The toner cartridge as claimed in claim 10, further comprising a seal fixedly provided at an outer side of said inner tube and attachable to an inner surface of said tubular portion of said housing, said seal having a slot in communication with the slot of said inner tube.

15. The toner cartridge as claimed in claim 14, wherein said seal has at least one outside stop wall attachable to the flat wall of said tubular portion of said housing.

* * * * *